US010330419B1

(12) United States Patent
Holderby

(10) Patent No.: US 10,330,419 B1
(45) Date of Patent: Jun. 25, 2019

(54) FIREARM SOUND SUPPRESSOR

(71) Applicant: TRAILBLAZER ARMS LLC, Highland Village, TX (US)

(72) Inventor: Seth A. Holderby, Corinth, TX (US)

(73) Assignee: TRAILBLAZER ARMS LLC, Highland Village, TX (US)

( * ) Notice: Subject to any disclaimer, the term of this patent is extended or adjusted under 35 U.S.C. 154(b) by 0 days.

(21) Appl. No.: 15/928,037

(22) Filed: Mar. 21, 2018

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325
USPC ..... 89/14.4; 181/223
See application file for complete search history.

(56) References Cited

U.S. PATENT DOCUMENTS

| | | | | |
|---|---|---|---|---|
| 2,987,966 | A * | 6/1961 | Meyer | F41A 21/26 89/14.5 |
| 5,164,535 | A * | 11/1992 | Leasure | F41A 21/30 181/223 |
| 6,308,609 | B1 | 10/2001 | Davies | |
| 6,848,538 | B2 * | 2/2005 | Shafer | F41B 11/00 181/223 |
| 7,832,323 | B1 * | 11/2010 | Davies | F41A 21/30 89/14.4 |
| 8,807,272 | B2 | 8/2014 | Bladen | |
| 8,991,551 | B2 | 3/2015 | Latka | |
| 9,080,829 | B1 * | 7/2015 | Cellini | F41A 21/36 |
| 9,410,761 | B2 | 8/2016 | Morris et al. | |
| 9,709,354 | B2 | 7/2017 | Larue | |
| 2014/0299405 | A1 | 10/2014 | Miller et al. | |
| 2016/0003570 | A1 | 1/2016 | Tonkin | |
| 2016/0018178 | A1 * | 1/2016 | Johansen | F41A 21/30 181/223 |
| 2016/0123689 | A1 * | 5/2016 | Maeda | F41A 21/30 89/14.3 |
| 2017/0003094 | A1 | 1/2017 | Person | |
| 2017/0299311 | A1 | 10/2017 | Daniel et al. | |
| 2017/0307323 | A1 | 10/2017 | Couvillion | |
| 2017/0321985 | A1 | 11/2017 | Bray | |

(Continued)

FOREIGN PATENT DOCUMENTS

| | | | |
|---|---|---|---|
| DE | 3735358 | A1 | 5/1989 |
| EP | 2653821 | A1 | 10/2013 |
| FR | 2256390 | A | 7/1975 |

*Primary Examiner* — Bret Hayes
(74) *Attorney, Agent, or Firm* — Mark Handley; Handley Law Firm, PLLC

(57) ABSTRACT

A firearm sound suppressor (12) has a baffle tube (20) and an exterior tube (14) which are concentrically disposed to define a single expansion chamber (56) there-between. A muzzle cap (16) encloses a first end of the expansion chamber (56) and has a plurality of flow ports (36) which provide fluid communication between a gun barrel muzzle and the expansion chamber (56). An end cap (18) encloses a second end of the expansion chamber (56). The end cap (18) has a bullet port (46) and vent ports (48) which extend circumferentially around the bullet port (46). Baffles (22) of tubular shape are pressed into the baffle tube (20) to provide a baffle stack (66). The baffles (22) have interiorly disposed upsets (78) which defines a gas check feature, causing spent propellant gases move into the entire volume of the expansion chamber (56) to reduce muzzle blast pressures.

20 Claims, 4 Drawing Sheets

(56) References Cited

U.S. PATENT DOCUMENTS

| | | | | |
|---|---|---|---|---|
| 2018/0245871 | A1* | 8/2018 | Goeggel | F41A 21/36 |
| 2018/0266783 | A1* | 9/2018 | Morreau | F41A 21/34 |

* cited by examiner

FIREARM SOUND SUPPRESSOR

TECHNICAL FIELD OF THE INVENTION

The present invention relates in general to firearms, and in particular to sound suppressors for firearms.

BACKGROUND OF THE INVENTION

Sound suppressors for firearms have been used for over a century to reduce the sound of muzzle blasts from firearms by impeding the rapid release of gases produced by ignited bullet propellant. Sound suppressors often have a plurality of baffles which are directly connected to one or more gas expansion chambers. The gas expansion chambers may be integral with or part of baffle components. Some firearms have integrated sound suppressors in which the barrel has multiple ports extending down the length of the barrel which are connected to one or more expansion chambers.

Prior art sound suppressors have also included wipers formed of soft materials which are mounted to extend across the bore of a suppressor and either have perforations which conform closely to the gauge of the round being fired or which are perforated by the first round being fired through a suppressor. Wipers provide a gas check feature to assure that propellant gases do not exit a firearm suppressor prior to the projectile exiting the suppressor. These type of wipers were lower cost and did not require precision machining. Wipers formed of soft material will typically have to be replaced after a few rounds are fired.

SUMMARY OF THE INVENTION

A firearm sound suppressor is disclosed having a muzzle cap, a baffle tube, an exterior tube, an end cap, and a plurality of baffles. The muzzle cap is configured for mounting to the muzzle of a gun barrel for a firearm. The baffle tube and the exterior tube are concentrically disposed with the baffle tube interiorly disposed within the exterior tube and an expansion chamber defined in the space there-between. The expansion chamber is a single chamber which runs the entire length of the suppressor. The muzzle cap connects to the rearward ends of the baffle tube and the exterior tube and encloses a first end of the expansion chamber, with a rearward end of the muzzle cap secured to the exterior tube and a forward end of the muzzle cap secured to the baffle tube. The forward end of the muzzle cap is spaced apart from the rearward end of the muzzle cap with a cage-like structure extending there-between to define a plurality of flow ports of elongate shape, extending from an interior of the muzzle cap to an exterior of the muzzle cap and providing fluid communication between the muzzle of the firearm and the expansion chamber. Preferably, the vent ports extend along a longitudinal length of the suppressor and are no longer than the length of a bullet being used, but may be longer. The vent ports are located adjacent the muzzle of the barrel and are fully open, that is, without obstruction, to allow for rapid and full utilization of the expansion chamber.

The end cap is mounted to forward ends of the exterior tube and the baffle tube, enclosing a second end of the expansion chamber. The end cap has a centrally disposed bullet port which is aligned with the gun barrel, the muzzle cap, and the baffle tube. Vent ports extend through the end cap disposed circumferentially around the bullet port, with the vent ports extending between the expansion chamber to an exterior of the suppressor for providing fluid communication there-between. The vent ports are of a size for restricting flow of propellant gases from the expansion chamber to the exterior of the suppressor, and for providing pressure relief when high pressures are encountered in the expansion chamber. The vent ports provide pressure relief, but restrict flow there-through and are not the primary means of evacuating propellent gases from the expansion chamber. The primary means of evacuating propellant gases from the expansion chamber is through the central bore of the suppressor, either through the baffles when used or through the baffle tube when baffles are not utilized in the suppressor, as noted below.

The plurality of baffles are tubular shaped and fit into the interior bore of the baffle tube to provide a baffle stack, which defines a central bore of the suppressor. The baffles are press fit into the baffle tube in a preferred embodiment, and in other embodiments the baffles may freely slide into the baffle tube. The baffles have sidewalls with continuous inner surfaces, that is, surfaces which are imperforate, without openings such that the sidewalls of the baffles seal between the central bore of the baffles and the baffle tube. Each of the baffles has a circumferentially extending upset which is an interiorly disposed protuberance provided by an annular-shaped tab extending radially inward. The upset or protuberance is located in a forward end of the respective baffles and provides a gas check. In some embodiments the baffles may be omitted and then the baffle tube sized in close tolerance to the bullet being used to provide the gas check feature. The gas check feature prevents spent propellant gases from moving outward of the suppressor prior to the bullet being fired, such that most of the propellant gases pass into and build pressure within the entire volume of expansion chamber.

DESCRIPTION OF THE DRAWINGS

For a more complete understanding of the present invention and the advantages thereof, reference is now made to the following description taken in conjunction with the accompanying Drawings in which

FIG. 1 is a perspective view of a firearm sound suppressor made according to the present invention;

FIG. 2 is an exploded view of the sound suppressor;

FIG. 3 is a longitudinal section view of the sound suppressor of FIG. 1 taken along section line 3-3;

FIG. 4 is a longitudinal section view of an exterior tube of the sound suppressor;

FIG. 5 is a longitudinal section view of a baffle tube of the sound suppressor;

FIG. 6 is a side view of a muzzle cap of the sound suppressor;

FIG. 7 is a sectional view of the muzzle cap taken along section line 7-7 of FIG. 6;

FIG. 8 is a left side view of an end cap of the sound suppressor;

FIG. 9 is a sectional view of the end cap taken along section line 9-9 of FIG. 8;

FIG. 10 is a sectional view of a baffle section for use in the sound suppressor of FIGS. 1-3;

FIG. 11 is a longitudinal section view of an alternative sound suppressor as would be viewed if taken along section line 3-3 of FIG. 1, showing the alternative sound suppressor as having an alternative baffle tube; and FIG. 12 is a longitudinal section view of the alternative baffle tube of the sound suppressor of FIG. 11.

DETAILED DESCRIPTION OF THE INVENTION

Figure 1:
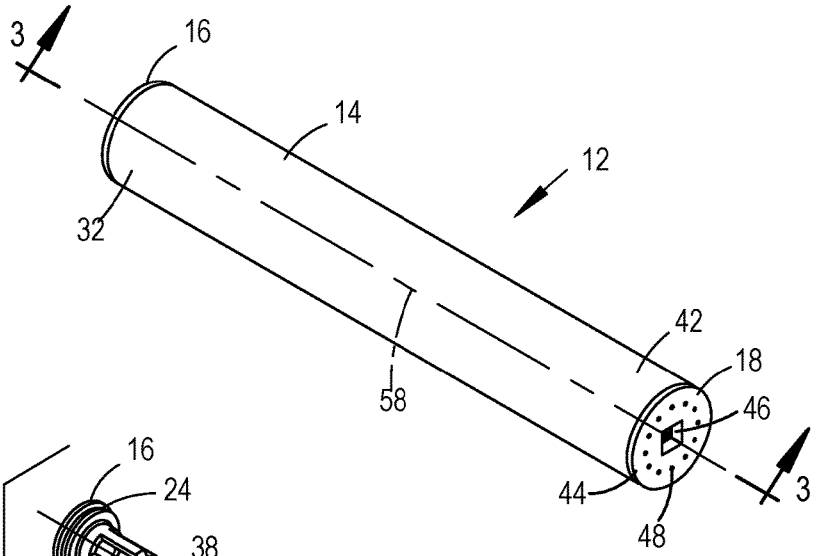
FIGS. 1 through 12 show various aspects for a firearm sound suppressor made according to the present invention, as set forth below.
Figure 2:
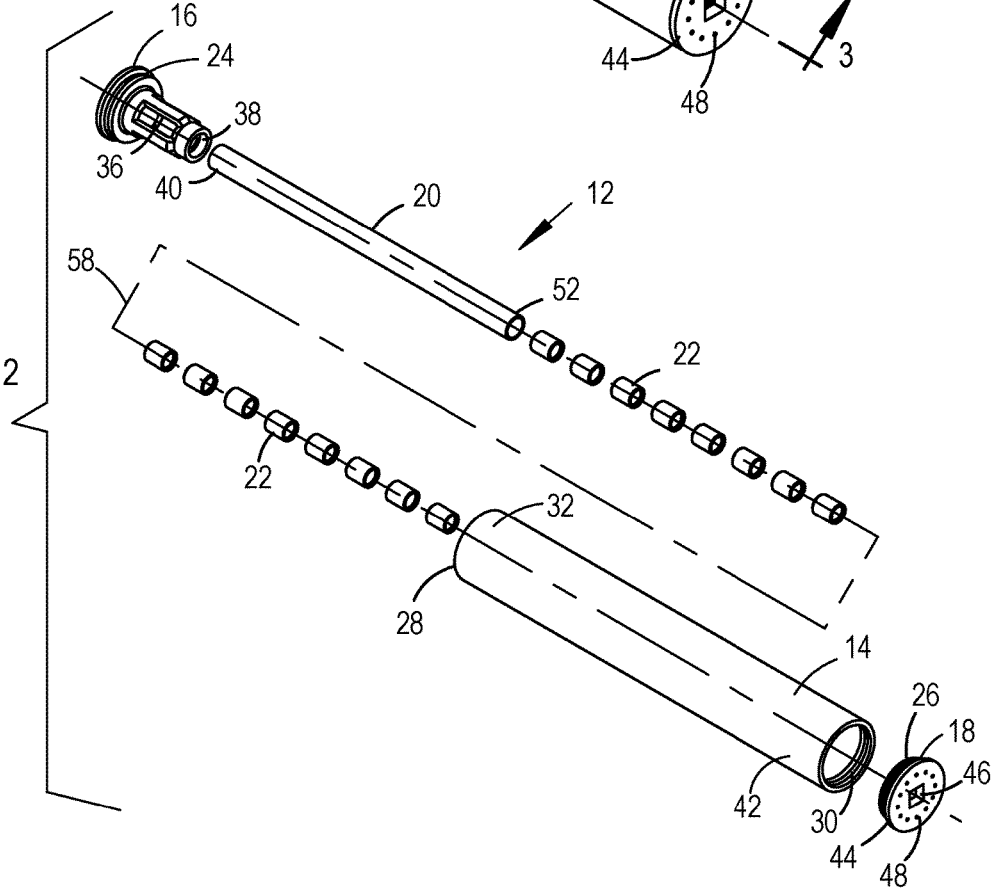

FIG. 1 is a perspective view of a firearm suppressor 12, and FIG. 2 is an exploded view of the firearm suppressor 12. The suppressor 12 has an exterior tube 14 running the full length thereof A muzzle cap 16 is disposed in a first end 32 of the exterior tube 14. An end cap 18 is disposed in a second end 42 of the exterior tube 14. A baffle tube 20 is provided which extends from the muzzle cap 16 to the end cap 18. A plurality of baffles 22 are provided for stacking within the baffle tube 20. In the present embodiment there are sixteen of the baffles 22 which are press fit into the baffle tube 20 to provide a columnar baffle stack 66 (shown in FIG. 3). The muzzle cap 16 has threads 24 which engage with interior threads 28 on the first end 32 of the exterior tube 14. The end cap 18 has exterior threads 26 which are provided for engaging with the interior threads 30 on the second end 42 of the exterior tube 14. The muzzle cap 16 has a cage-like structure 34 having a plurality of flow ports 36 of elongate shape. The flow ports 36 extend radially around the exterior of the cage-like structure 34. A terminal end of the muzzle cap 16 has a socket 38 for receiving a first end 40 of the baffle tube 20. The end cap 18 has a body with a disk-like shape 44, and a bullet port 46 which is preferably a squared shape extending there-through. A plurality of vent ports 48 extend circumferentially around the bullet port 46. A rearward end of the end cap 18 has a socket 50 for receiving a second end 52 of the baffle tube 20.

Figure 3:
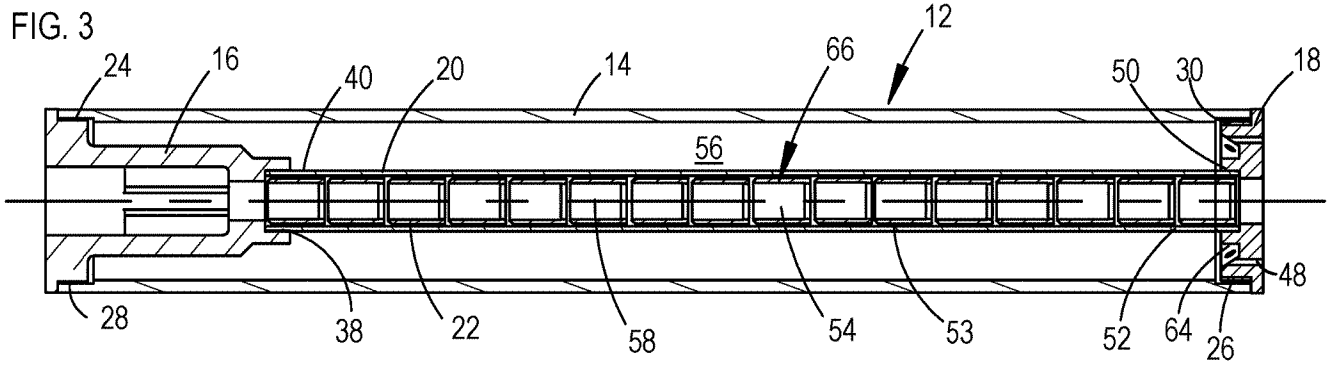

FIG. 3 is a longitudinal section view of the suppressor 12, taken along section line 3-3 of FIG. 1. An expansion chamber 56 is defined by an annular-shaped space 56 extending between the exterior tube 14 and the baffle tube 20, having a length extending from the muzzle cap 16 to the end cap 18. The expansion chamber 56 is a single chamber which runs the entire length of the suppressor 12, unobstructed for the entire length thereof. The flow ports 36 in the muzzle cap 16 provide fluid communication between the expansion chamber 56 and a central bore 54 of the suppressor 12 and the muzzle of a gun barrel to which the suppressor 12 is mounted. The flow ports 36 are disposed in the first end of the suppressor 12 which mounts directly to the barrel of a firearm, and the central bore 54 of the suppressor 12 is only connected to the expansion chamber 56 through the vent ports 36 located in the first end of the suppressor 12. Preferably, the flow ports 36 extend along a longitudinal length of the suppressor 12 for no longer than the length of a bullet being used, but may be longer. The flow ports 36 are located adjacent the muzzle of the barrel and are fully open, without obstruction, to allow for rapid and full utilization of the expansion chamber 56.

Figure 11:
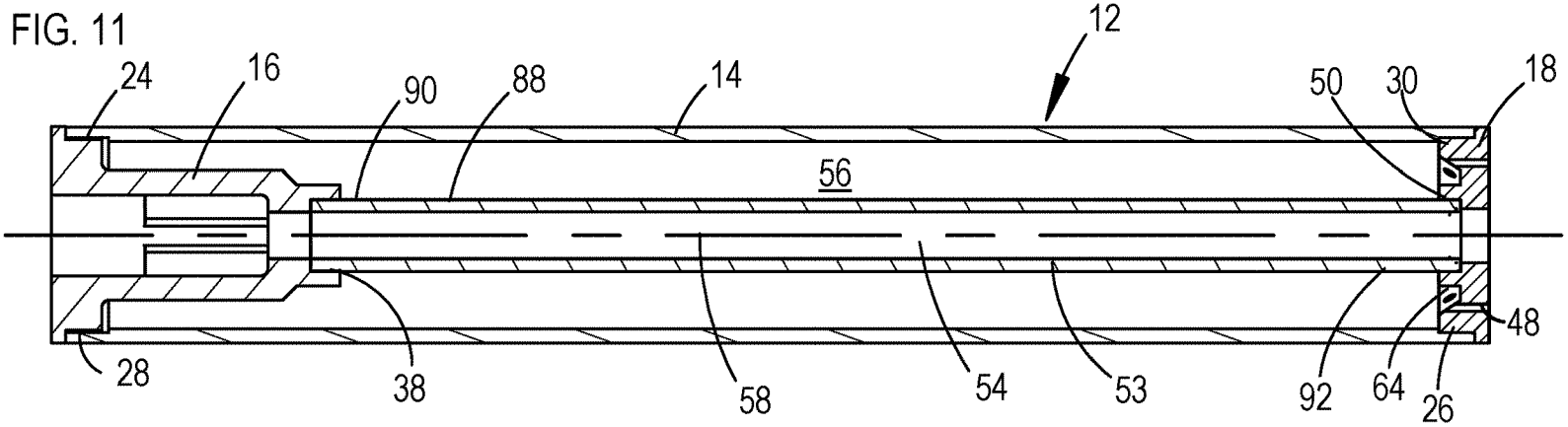
Figure 12:
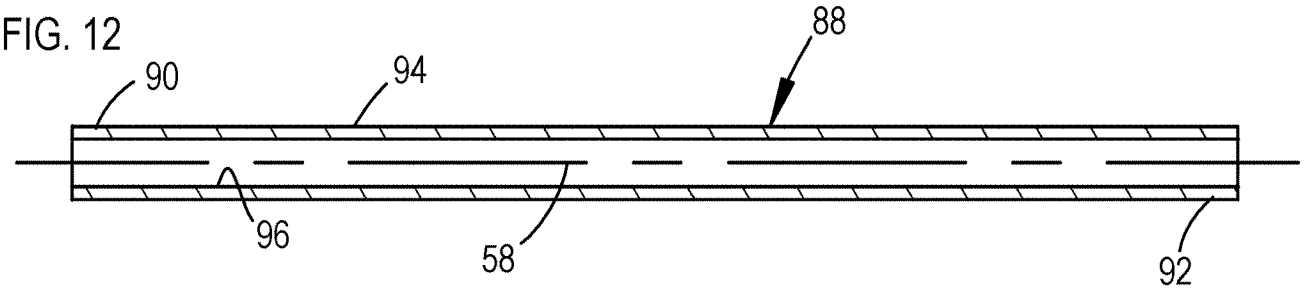

The baffle tube 20 has a sidewall 86 which is imperforate, being continuous and not having any ports extending through the sidewall 86 of the baffle tube 20 to connect the interior of the baffle tube 20 with the expansion chamber 56. The propellant gases only pass through flow ports 36 in the muzzle cap 16, and not through any portion of the sidewall 86 of the baffle tube 20. A longitudinal axis 58 extends centrally through the suppressor 12, co-axial with the exterior tube 14, the muzzle cap 16, the end cap 18, the baffle tube 20, and the baffles 22. An annular-shaped groove 64 is provided in the rearward face of the end cap 18, in fluid communication with the expansion chamber 56. The plurality of baffles 22 are stacked end-to-end within the interior of the baffle tube 20 to define a baffle stack 66. There are preferably sixteen baffles in the present embodiment. Preferably the baffles 22 are press fit into the interior surface of the baffle tube 20. In some embodiments, as shown in FIGS. 11 and 12, the baffles 22 which were included in the interior bore 84 of the baffle tube 20 may be omitted may be omitted and an alternative baffle tube 88 used, instead of the baffle tube 20. The alternative baffle tube 88 is sized with an inner bore 96 to both freely pass a bullet passing through the suppressor 12 and provide a gas check feature in which propellant gases are prevented from flowing past the bullet being fired through the suppressor 12, such that most of the propellant gases are forced to pass through the vent ports 36 and into the expansion chamber 56.

Figure 4:
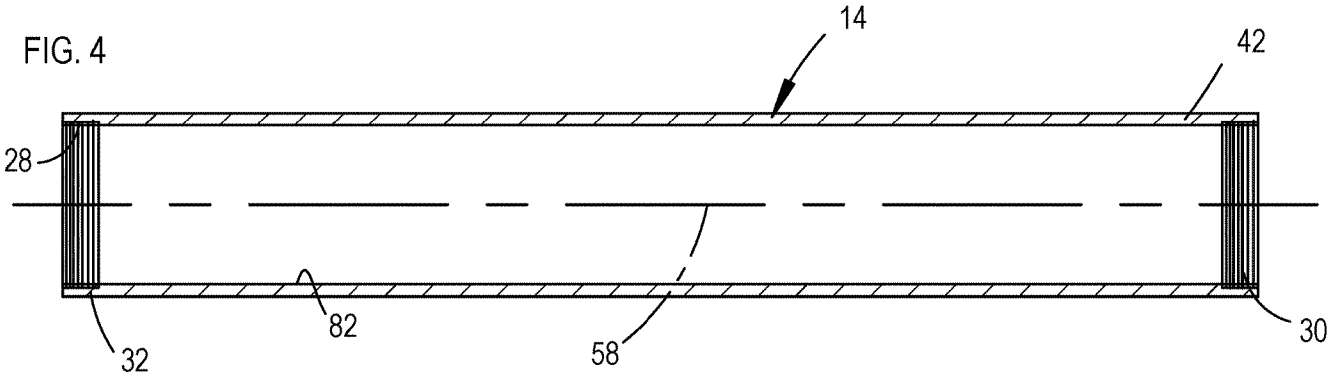

FIG. 4 is a longitudinal section view of the exterior tube 14 of the sound suppressor 12. The exterior tube 14 has sidewall which is preferably coaxial with the longitudinal axis 58 and an interior bore 82. Threads 28 are formed into the interior of the exterior tube 14 at the first end 32, and threads 30 are formed into the interior of the exterior tube 14 at the second end 42. The exterior tube 14 has a tubular body which is preferably imperforate, such that sidewalls thereof are continuous and without perforations or other openings through which propellant gases could flow.

Figure 5:
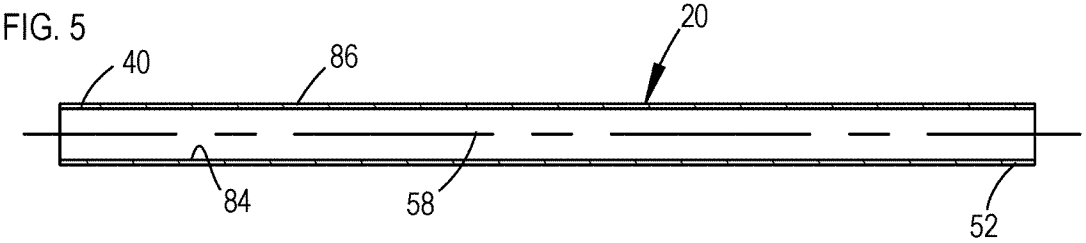

FIG. 5 is a longitudinal section view of a baffle tube 20 of the sound suppressor 12. The baffle tube 20 has a rearward end defined by a first end 40 and a forward end defined by a second end 52. Preferably the first end 40 and the second end 52 are of uniform shape, not having threads nor reduced diameters. The baffle tube 20 has a tubular body with a sidewall 86 which is imperforate, that is, the sidewall 86 is continuous since it is without perforations or other openings through which propellant gases could flow and without upsets. The baffle tube 20 has an interior bore 84 which in other embodiments in which baffles 22 are not used will be sized to provide a gas check feature, and then will provide the central bore 54 for the suppressor 12 through which bullets pass.

Figure 6:
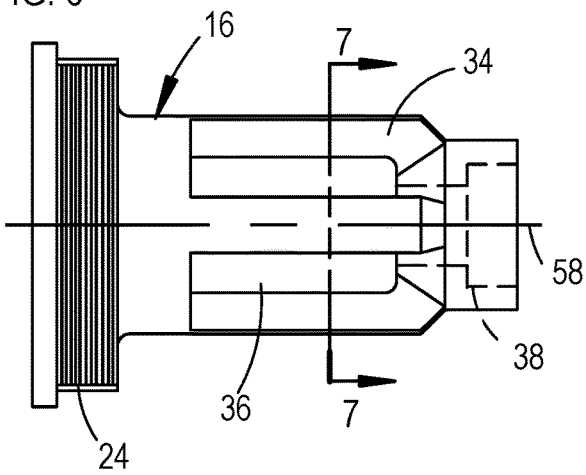
Figure 7:
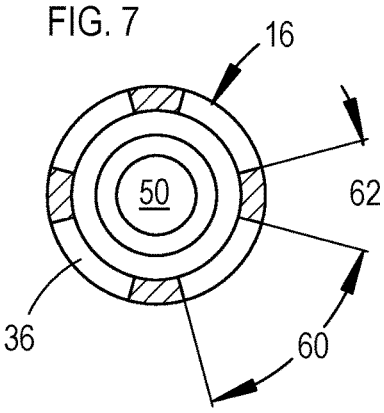

FIG. 6 is a side view of a muzzle cap 16 and FIG. 7 is a sectional view of the muzzle cap 16, taken along section line 7-7 of FIG. 6. The muzzle cap 16 has threads 24 which are provided for engaging with interior threads 28 on the first end 32 of the exterior tube 14. The muzzle cap 16 has a cage-like structure 34 having a plurality of vent ports 36 of elongate shape. The vent ports 36 extend radially around the exterior of the cage-like structure 34, defining, or providing, openings which preferably extend about the longitudinal axis 58 at an angle 60 of approximately sixty degrees. The vent ports 36 are spaced apart by metal ribs defining the cage-like structure 34 which preferably extend for an angle 62 of approximately thirty degrees around the longitudinal axis 58. A terminal end of the muzzle cap 16 has a socket 38 for receiving a first end 40 of the baffle tube 20.

Figure 8:
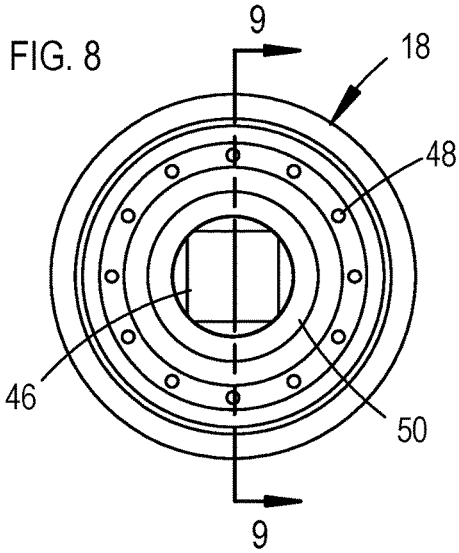
Figure 9:
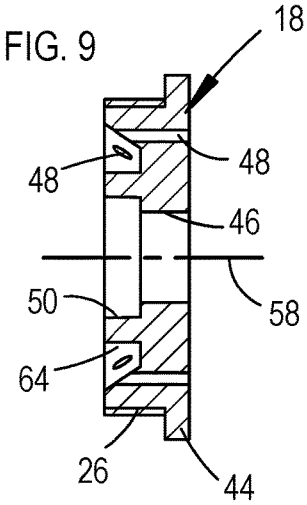

FIG. 8 is a left side view of an end cap 18 and FIG. 9 is a sectional view of the end cap 18, taken along section line 9-9 of FIG. 8. The end cap 18 has a body with a disk-like shape 44, and a bullet port 46 which is preferably a squared shape extending there-through. A rearward end of the end cap 18 has a socket 50 for receiving a second end 52 of the baffle tube 20. The end cap 18 has exterior threads 26 which are provided for engaging with the interior threads 30 on the second end 42 of the exterior tube 14. A plurality of the vent ports 48 extend circumferentially around the bullet port 46. The vent ports 48 provide pressure relief ports which are sized for restricting flow of propellant gases from the expansion chamber 56 to the exterior of the suppressor 12, and for providing pressure relief when high pressures are encountered in the expansion chamber 56. The vent ports 48 are not the primary means of evacuating propellent gases from the expansion chamber 56. The primary means of evacuating propellant gases from the expansion chamber is through the central bore 54 of the suppressor 12, either through the interior bore 54 of the baffles 22 as in the present embodiment, or in other embodiments, such as shown in FIGS. 11 and 12, through an appropriately sized inner bore 96 of the alternative baffle tube 88 when the baffles 22 are not utilized in the suppressor 12 and the inner bore 96 of the alternative baffle tube 88 then provides the central bore for the suppressor 12.

Figure 10:
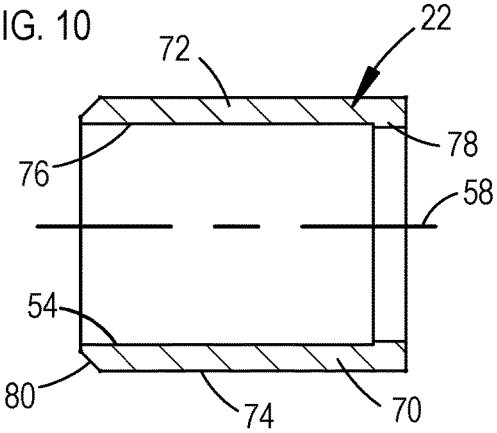

FIG. 10 is a longitudinal section view of one of the baffles 22, taken along section line 3-3 of FIG. 1. The baffle 22 has a tubular body 70 which is preferably of a uniform cylindrical shape having a central bore 54 and an inwardly extending protuberance provided by an upset 78. The upset 78 is preferably an annular-shaped tab which extends inward at the forward end of the tubular body 70 for a small distance, such that the baffle does not provide an integral expansion chamber for propellant gases. Rather, the baffles 22 only provide the gas check feature and do not provide a propellant gas expansion feature within the tubular bodies 70 of the baffles 22. The gas check feature prevents propellant gases from passing around a bullet traveling through the suppressor 12. The tubular body 70 is preferably imperforate, such that a sidewall 72, an outer surface 74 and an inner surface 76 are continuous and without perforations or other openings through which propellant gases could flow. Both the outer surface 74 and the inner surface 76 of the sidewall 72 are substantially uniform except for an annular-shaped upset 78. An end bevel 80 is provided on the rearward end of the cylindrical body 72 of the baffle 22 to aid in inserting the baffle 22 into the baffle tube 20. It should be noted that the volume of the interior of the cylindrical body 72 is such that it does not provide for expansion of propellant gases, but merely passage of a bullet projectile there through, with the continuous inner surface 76 being nearly the same size as the outside diameter of a bullet projectile.

FIG. 11 is a longitudinal section view of the sound suppressor 12 as would be viewed if taken along section line 3-3 of FIG. 1, when used with an alternative baffle tube 88 instead of the baffle tube 20 and the baffles 22. Similar to the baffle tube 20 of FIGS. 3 and 5, the alternative baffle tube 88 is imperforate, being continuous and not having any ports extending through a sidewall 94 of the baffle tube 88 to connect the interior of the baffle tube 88 to the expansion chamber 56. The propellant gases only pass through flow ports 36 in the muzzle cap 16, and not through any portion of the sidewall 94 of the baffle tube 88. The longitudinal axis 58 extends centrally through the suppressor 12, co-axial with the exterior tube 14, the muzzle cap 16, the end cap 18, and is coaxial with the baffle tube 88. The baffles 22 of FIG. 3 are not used with the alternative baffle tube 88, but instead the interior bore 96 of the baffle tube 88 is sized to both freely pass a bullet passing through the suppressor 12 and provide a gas check feature in which propellant gases are prevented from flowing past a bullet passing through the suppressor 12, such that most of the propellant gases are forced to pass through the vent ports 36 and into the expansion chamber 56.

FIG. 12 is a longitudinal section view of the alternative baffle tube 88 of the sound suppressor 12 of FIG. 11. The baffle tube 88 has a rearward end defined by a first end 90 and a forward end defined by a second end 92. Preferably the first end 90 and the second end 92 are of uniform shape, not having threads nor peripheries with reductions in diameter. The baffle tube 88 has a tubular body with a sidewall 94 which is imperforate, that is, the sidewall 94 is continuous since it is without perforations or other openings through which propellant gases could flow and without upsets. The baffle tube 88 has the interior bore 96.

The present invention provides advantages of a firearm suppressor having a single expansion chamber which is annular-shaped and runs the full length of the firearm suppressor. Fluid communication between the central bore of the suppressor and the expansion chamber occurs only at the rearward end of the suppressor, adjacent to the firearm muzzle to which the suppressor is mounted. A plurality of baffles each provide gas brakes and do not have internal expansion chambers nor flow passages passing through sidewalls thereof and into an external expansion chamber. A plurality of pressure relief ports are provided by vent ports located in a circumferentially extending section in the end cap. A restricted central bore of the suppressor provides the gas check feature to prevent spent propellant gases from moving past a bullet passing through the suppressor, causing a majority portion of the propellant gases to pass through vent ports located by a firearm gun barrel muzzle and into the expansion chamber.

Although the preferred embodiment has been described in detail, it should be understood that various changes, substitutions and alterations can be made therein without departing from the spirit and scope of the invention as defined by the appended claims.

What is claimed is:

1. A firearm sound suppressor comprising:

a baffle tube having a central bore of said sound suppressor disposed interiorly therein, said central bore configured to both provide a pathway for bullets to pass through said sound suppressor and provide a gas check feature;

an exterior tube concentrically disposed around said baffle tube to define a space there-between, wherein said space provides an expansion chamber;

a muzzle cap enclosing a first end of said expansion chamber, said muzzle cap having a rearward end and a forward end, with said rearward end having a larger diameter than said forward end for connecting said rearward end to a first end of said exterior tube and to a muzzle of a firearm, and said forward end having a smaller diameter than said rearward end for connecting to a first end of said baffle tube, wherein said forward end is spaced apart from said rearward end of said baffle tube and a plurality of flow ports extend there-between, from an interior of said muzzle cap to an exterior of said muzzle cap and providing fluid communication from the muzzle of the firearm to said expansion chamber;

an end cap mounted to a second end of said exterior tube and to a second end of said baffle tube, and enclosing a second end of said expansion chamber, wherein said end cap seals between said baffle tube and said exterior tube; and wherein said gas check feature provided by said central bore prevents spent propellant gases from passing through said central bore ahead of respective ones of the bullets such that at least part of said propellant gases pass into said expansion chamber.

2. The firearm sound suppressor according to claim 1, further wherein said baffle tube has an interior bore, with said interior bore sized for providing said central bore of said sound suppressor and said gas check feature.

3. The firearm sound suppressor according to claim 1, further comprising a plurality of baffles of tubular shape for disposing within an interior bore of said baffle tube to provide a baffle stack and to together define said central bore of said sound suppressor, wherein said baffles have sidewalls defining imperforate inner surfaces which seal between said central bore and said baffle tube.

4. The firearm sound suppressor according to claim 3, further comprising said baffles having at least one upset extending into said central bore to provide said gas check feature.

5. The firearm sound suppressor according to claim 3, wherein each of said baffles have an interiorly disposed upset in a forward end which defines said gas check feature.

6. The firearm sound suppressor according to claim 5, wherein said baffles are cylindrically shaped and said upset is annular-shaped.

7. The firearm sound suppressor according to claim 1, wherein said end cap has a bullet port and vent ports extending circumferentially around said bullet port, with said vent ports extending from said expansion chamber to an exterior of said sound suppressor and providing fluid communication there-between for pressure relief and said vent ports are of a size for restricting flow of propellant gases there-through.

8. The firearm sound suppressor according to claim 1, wherein said exterior tube and said baffle tube are cylindrically shaped, and said expansion chamber is annular-shaped.

9. A firearm sound suppressor comprising:

a baffle tube having a central bore of said sound suppressor disposed interiorly therein, said central bore sized to both provide a pathway for bullets to pass through said sound suppressor and provide a gas check feature;

an exterior tube concentrically disposed around said baffle tube to define a space there-between, wherein said space provides an expansion chamber;

a muzzle cap enclosing a first end of said expansion chamber, said muzzle cap having a rearward end and a forward end, with said rearward end having a larger diameter than said forward end for securing said rearward end to a first end of said exterior tube and to a muzzle of a firearm, and said forward end having a smaller diameter than said rearward end for securing to a first end of said baffle tube, wherein said forward end is spaced apart from said rearward end with a plurality of flow ports extending from an interior of said muzzle cap to an exterior of said muzzle cap and providing fluid communication from said interior bore of said baffle tube to said expansion chamber;

an end cap mounted to a second end of said exterior tube and to a second end of said baffle tube, and enclosing a second end of said expansion chamber, wherein said end cap seals between said baffle tube and said exterior tube;

said end cap having a bullet port and vent ports extending circumferentially around said bullet port, with said vent ports extending from said expansion chamber to an exterior of said sound suppressor and providing fluid communication there-between and said vent ports are of a size for restricting flow of propellant gases there-through;

a plurality of baffles of tubular shape for disposing within said interior bore of said baffle tube to provide a baffle stack and to together define said central bore of said sound suppressor, wherein said baffles have sidewalls defining continuous inner surfaces which seal between said central bore and said baffle tube; and wherein said gas check feature provided by said central bore prevents spent propellant gases from passing through said central bore ahead of respective ones of the bullets such that at least part of said propellant gases pass into said expansion chamber.

10. The firearm sound suppressor according to claim 9, further comprising said baffles having at least one upset extending into said central bore to provide said gas check feature.

11. The firearm sound suppressor according to claim 9, wherein each of said baffles have an interiorly disposed upset in a forward end which defines said gas check feature.

12. The firearm sound suppressor according to claim 11, wherein said baffles are cylindrically shaped and said upset is annular-shaped.

13. The firearm sound suppressor according to claim 9, wherein said exterior tube and said baffle tube are cylindrically shaped, and said expansion chamber is annular-shaped.

14. A firearm sound suppressor comprising:

a baffle tube having a central bore of said sound suppressor disposed interiorly therein, said central bore sized to both provide a pathway for bullets to pass through said sound suppressor and provide a gas check feature;

an exterior tube concentrically disposed around said baffle tube to define an annular-shaped space there-between, wherein said annular-shaped space provides an expansion chamber;

a muzzle cap enclosing a first end of said expansion chamber, said muzzle cap having a rearward end and a forward end, with said rearward end having a larger diameter than said forward end, said rearward end having exterior threads for securing to interior threads of a first end of said exterior tube, and said first end having a forward facing socket for receiving said baffle tube, wherein said forward end is spaced apart from said rearward end with a cage-like structure extending there-between to define a plurality of flow ports of elongate shape which extend from an interior of said muzzle cap to an exterior of said muzzle cap and provide fluid communication from the muzzle of the firearm to said expansion chamber;

an end cap having exteriorly disposed threads for securing to a threaded second end of said exterior tube, said end cap having a rearward facing socket for receiving a second end of said baffle tube, wherein said end cap encloses a second end of said expansion chamber, sealing between said baffle tube and said exterior tube;

a plurality of baffles of tubular shape for disposing within said interior bore of said baffle tube to provide a baffle stack and to together define a central bore of said sound suppressor, wherein said baffles have sidewalls defining continuous inner surfaces which seal between said central bore and said baffle tube.

15. The firearm sound suppressor according to claim 14, further comprising said end cap having a bullet port and vent ports extending circumferentially around said bullet port, with said vent ports extending from said expansion chamber to an exterior of said sound suppressor and providing fluid communication there-between for pressure relief and said vent ports are of a size for restricting flow of propellant gases there-through.

16. The firearm sound suppressor according to claim 14, further comprising said baffles having at least one upset extending into said central bore to provide said gas check feature.

17. The firearm sound suppressor according to claim 14, wherein each of said baffles have an interiorly disposed upset in a forward end which defines said gas check feature.

18. The firearm sound suppressor according to claim 17, wherein said baffles are cylindrically shaped and said upset is annular-shaped.

19. The firearm sound suppressor according to claim 18, wherein said exterior tube and said baffle tube are cylindrically shaped, and said expansion chamber is annular-shaped.

20. The firearm sound suppressor according to claim 19, further comprising said end cap having a bullet port and vent ports extending circumferentially around said bullet port, with said vent ports extending from said expansion chamber to an exterior of said sound suppressor and providing fluid communication there-between for pressure relief and said vent ports are of a size for restricting flow of propellant gases there-through.

* * * * *